US007589510B2

(12) United States Patent
Bodano

(10) Patent No.: US 7,589,510 B2
(45) Date of Patent: Sep. 15, 2009

(54) VOLTAGE REGULATOR HAVING VARIABLE THRESHOLD VOLTAGE SWITCH

(75) Inventor: Emanuele Bodano, Padua (IT)

(73) Assignee: Infineon Technologies AG, Munich (DE)

( * ) Notice: Subject to any disclaimer, the term of this patent is extended or adjusted under 35 U.S.C. 154(b) by 266 days.

(21) Appl. No.: 11/648,188

(22) Filed: Dec. 29, 2006

(65) Prior Publication Data

US 2008/0157741 A1 Jul. 3, 2008

(51) Int. Cl.
*G05F 1/56* (2006.01)

(52) U.S. Cl. ..... 323/284; 323/285

(58) Field of Classification Search ..... 323/282, 323/284, 285

See application file for complete search history.

(56) References Cited

U.S. PATENT DOCUMENTS 5,666,045 A * 9/1997 Grodevant ..... 323/282
5,929,615 A * 7/1999 D'Angelo et al. ..... 323/224
6,744,288 B1 6/2004 Doyle et al.
6,801,033 B2 * 10/2004 Sudo et al. ..... 324/158.1
7,253,592 B2 * 8/2007 Leyk et al. ..... 323/222
2002/0185681 A1 12/2002 Nakano et al.
2004/0239304 A1 12/2004 Perez
2006/0007618 A1 * 1/2006 Leyk et al. ..... 361/90
2007/0057655 A1 * 3/2007 Nishida ..... 323/282
2007/0210779 A1 * 9/2007 Itoh ..... 323/284

OTHER PUBLICATIONS

Rincon-Mora, Gabriel A., and Phillip E. Allen. "A Low-Voltage, Low Quiescent Current, Low Drop-Out Regulator." *IEEE Journal of Solid-State Circuits*. vol. 33. Jan. 1998. pp. 36-44. (9 Pages).

* cited by examiner

*Primary Examiner*—Jeffrey L Sterrett
(74) *Attorney, Agent, or Firm*—Maginot, Moore & Beck

(57) ABSTRACT

A voltage regulator includes a power field effect transistor and a control-loop circuit. The power field effect transistor has a threshold voltage, a drain terminal receiving an input voltage, a source terminal providing an output voltage and a load current, a gate terminal responsive to a control signal, and a bulk terminal. The control-loop circuit is responsive to the output voltage and providing the control signal, and is configured to adjust the control signal to such a value that the output voltage is regulated to a constant value. In addition, the threshold voltage of the power field effect transistor is modified dependent on the load current.

9 Claims, 4 Drawing Sheets

VOLTAGE REGULATOR HAVING VARIABLE THRESHOLD VOLTAGE SWITCH

TECHNICAL FIELD

The present invention relates to voltage regulators.

BACKGROUND

A low voltage drop over the voltage regulator is achieved by the use of a MOSFET as a voltage regulating element together with a charge pump providing a sufficiently high gate potential which has to be higher than the output voltage of the voltage regulator, in the case of a low drop regulator even higher than the input voltage of the voltage regulator.

In order to guarantee a substantially constant output voltage, the gate of the voltage regulating MOSFET (e.g. a power MOSFET) is supplied with a bias current provided by a charge pump and controlled by a closed loop control system. That is, the output voltage of the voltage regulator is received by a controller which controls the gate current (and therefore the gate voltage) of the voltage regulating MOSFET such, that the output voltage of the voltage regulator remains substantially constant.

In response to an upward step of the load current (i.e. the output current) the output voltage will slightly drop due to the higher voltage drop over the voltage regulating MOSFET. Triggered by this voltage drop the controller will increase the gate current for charging the gate-source-capacitance of the voltage regulating MOSFET in order to increase the conductivity of the voltage regulating MOSFET thus re-adjusting the output voltage to its desired value.

The time which is needed to compensate for the disturbance in the output voltage induced by the step in a load current is determined by the loop bandwidth of the closed loop control system and especially dependent on the value of the gate-source-capacitance of the voltage regulating MOSFET.

With a given value of the gate-source-capacitance of the voltage regulating MOSFET the speed of the closed loop control system can only be increased by increasing the gate current which charges the gate of the MOSFET. This gate current is supplied by a charge pump, as explained before, and, in order to minimize power consumption, an increase of the maximum gate current which would entail a more costly charge pump is not desirable.

SUMMARY

In one embodiment of the invention the inventive voltage regulator comprises a power filed effect transistor having a threshold voltage, a drain terminal receiving an input voltage, a source terminal providing an output voltage and a load current, a gate terminal responsive to a control signal, and a bulk terminal. The voltage regulator further comprises a control loop circuits responsive to the output voltage and providing the control signal. The control loop circuit is adapted for adjusting said control signal to such a value that the output voltage is regulated to a desired (constant) value. Additionally the threshold voltage of the power field effect transistor is modified dependent on the load current. Alternatively the threshold voltage can be modified dependent on the output voltage or on both, the output voltage and the load current.

In another embodiment of the invention the voltage regulator additionally comprises a switching circuit for modifying the threshold voltage. The switching circuit is responsive to the output voltage and/or to the load current and it is adapted for connecting the bulk terminal of the field effect transistor with either the source terminal or a constant potential dependent on the load currents and/or the output voltage.

Another aspect of the invention also comprises a method for controlling the power field effect transistor which was defined above. In one embodiment the method comprises the step of modifying the threshold voltage dependent on the load current and/or the output voltage. This can be done, for example, by a connecting the bulk terminal of the field effect transistor with either the source terminal or a constant potential dependent on the load current and/or the output voltage.

BRIEF DESCRIPTION OF THE DRAWINGS

The invention can be better understood with reference to the following drawings and description. The components in the figures are not necessarily to scale, instead emphasis being placed upon illustrating the principles of the invention. Moreover, in the figures, like reference numerals designate corresponding parts. In the drawings.

DETAILED DESCRIPTION

Figure 1:
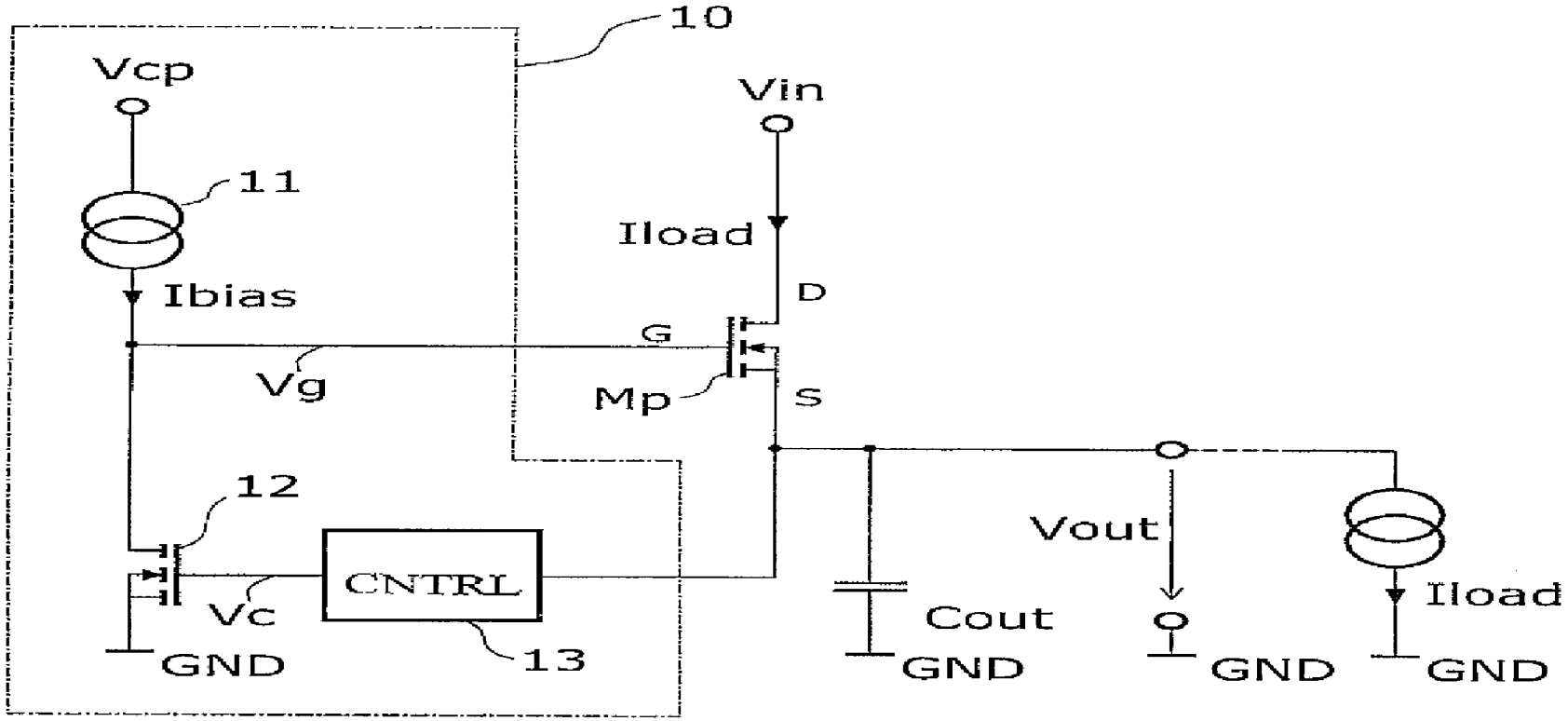
FIG. 1 shows a conventional voltage regulator with a power MOSFET as a regulating element and a feedback circuit for regulating the output voltage to a desired constant value.

FIG. 1 shows a simple voltage regulator using a power MOSFET Mp as a voltage regulating element. In the embodiment shown in FIG. 1 a n-MOS transistor is used whose drain terminal D is connected to a first supply terminal receiving an input voltage Vin and whose source terminal S is connected to an output terminal providing an output voltage Vout and a load current Iload. For compensating for high frequency current spikes a capacitance Cout is connected between the source terminal S and a second supply terminal, e.g. a ground terminal GND. The voltage regulator further comprises a feedback circuit 10 for regulating the output voltage Vout, i.e. the source potential of the power MOSFET, to a desired (e.g. constant) value.

The feedback circuit 10 comprises a controller 13 whose input is connected to the source terminal S and responsive to the output voltage Vout. The output of the controller 13 provides a controller voltage Vc received by the gate of a controlling transistor 12 whose source terminal is connected to the ground terminal GND and whose drain terminal is connected to the gate G of the voltage regulating power MOSFET Mp and to a current source 11 providing a bias current Ibias to the gate G and to the controlling transistor 12. The current source 11 is connected to a third supply terminal receiving a supply voltage Vcp provided by a charge pump (not shown).

Figure 4:
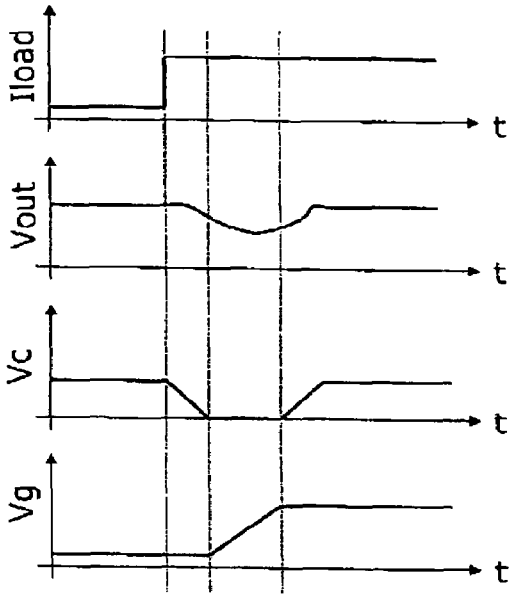
FIG. 4 shows timing diagrams of the load current, the output voltage and the gate voltage illustrating the step response of a voltage regulator according to FIG. 1.

The function of the feedback circuit can be easily understood with the help of the timing diagrams shown in FIG. 4. FIG. 4 illustrates the step response of the output voltage Vout, the controller voltage Vc, and the gate voltage Vg to an upward step of the load current Iload. In the circuit of FIG. 1 with a given output voltage Vout, a given load current Iload, and a given supply voltage Vin the drain-source voltage Vds of the power MOSFET Mp has been adjusted by the feedback circuit 10 such, that drain-source voltage Vds (i.e. the product RDS×Iload of the drain-source resistance RDS and the load current Iload) is equal to the difference between the supply voltage Vin and the output voltage Vout. An upward step of the load current Iload firstly results in a drop of the output voltage Vout. Triggered by this voltage drop the controller 13 reduces the controller voltage Vc, i.e. the gate voltage of the controlling transistor 12, thus increasing the fractional part of the bias current Ibias used for charging the gate (i.e. the gate-source-capacitance) of the power MOSFET Mp. An increased gate charge results in a higher gate voltage Vg of the power MOSFET and in a lower drain-source voltage Vds (i.e. in a lower drain-source resistance RDS) which compensates for the higher load current Iload, thus readjusting the output voltage to its desired (constant) value.

The time which is needed to readjust the drop in the output voltage Vout to its desired constant value depends on the time the feedback circuit 10 needs to react to a drop in the output voltage, i.e. the loop delay time tL, the time which is needed to charge the gate-source capacitance of the power MOSFET Mp, i.e. the charging time tC. The loop delay time tL depends on the bandwidth of the feedback circuit 10 and is usually much smaller than the charging time tC. To decrease the overall delay time tD (TD=tL+tC) it is necessary to reduce the charging time tC, which could be done by increasing the bias current Ibias which would entail higher costs for the current source 11 and the charge pump.

Figure 2:
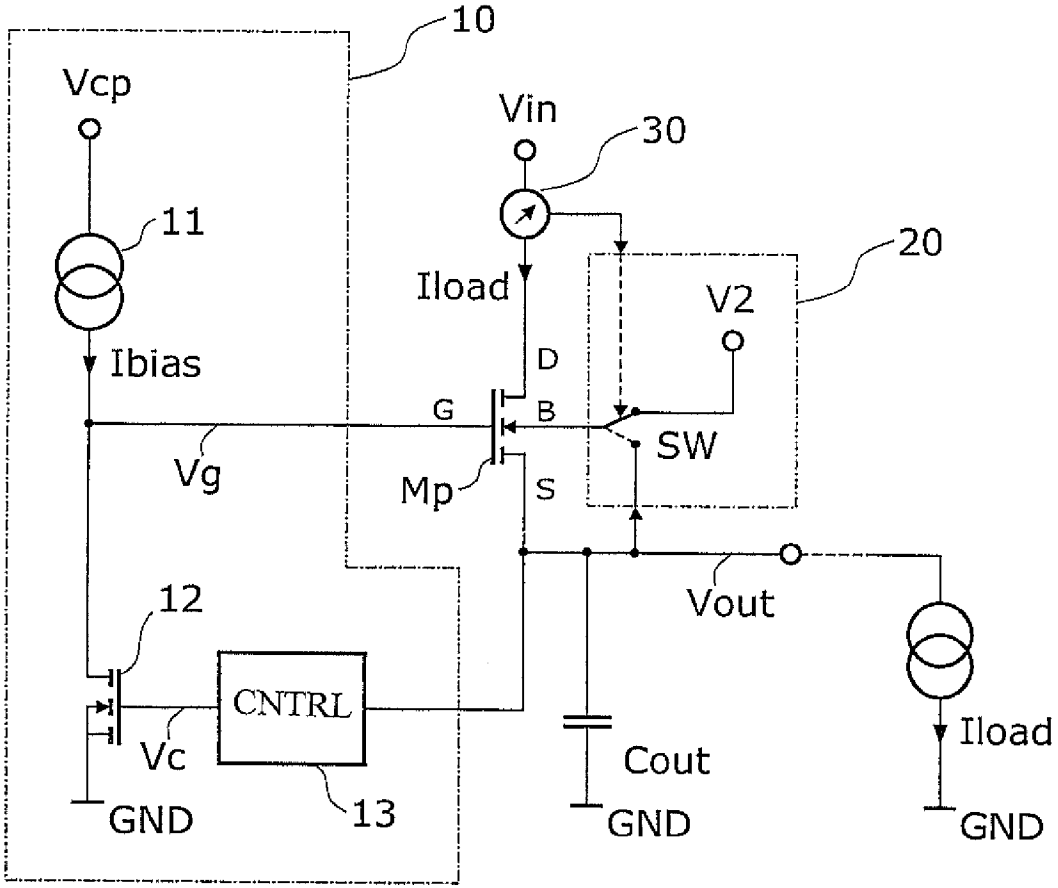
FIG. 2 shows one embodiment of the inventive voltage regulator comprising a switching circuit for modifying the threshold voltage of the voltage regulating power MOSFET.

Another possibility to improve the overall delay tD time without the need for increasing the bias current Ibias is shown in FIG. 2. compared to the circuit of FIG. 1 a current measurement means 30 is connected in series to the drain-source path of the power MOSFET Mp. In the case of FIG. 2 the current measurement means is connected between the drain terminal D of the power MOSFET Mp and the supply terminal receiving Vin. The current measurement means 30 provides a measurement signal S30 which depends on the load current Iload. The voltage regulator further comprises a switching circuit 20 being responsive to the load current Iload (or, strictly speaking, to the measurement signal S30). The switching circuit 20 is connected to the output terminal providing the output voltage Vout (i.e. the source potential) and with the bulk terminal B of the power MOSFET Mp. The switching circuit comprises a switch SW responsive to the measurement signal S30. The switch SW is adapted for connecting the bulk terminal B of the power MOSFET Mp with either the source terminal S or a constant potential V2 dependent on the value of the load current Iload or the measurement signal S30 respectively.

The constant potential V2 is preferably lower than the output voltage Vout and can also be equal to ground potential GND. An "ordinary" MOSFET would have its bulk terminal B connected to its source terminal S. Compared to this switching state (a first switching state) the threshold voltage of the power MOSFET Mp increases, if the switch SW connects the bulk terminal B of the power MOSFET Mp with the constant potential V2 being lower than the source potential (Vout) of the power MOSFET Mp. This state of the switch SW is further referred to as the second switching state. The function of the circuit is explained in more detail by reference to FIGS. 3 and 5.

Figure 3:
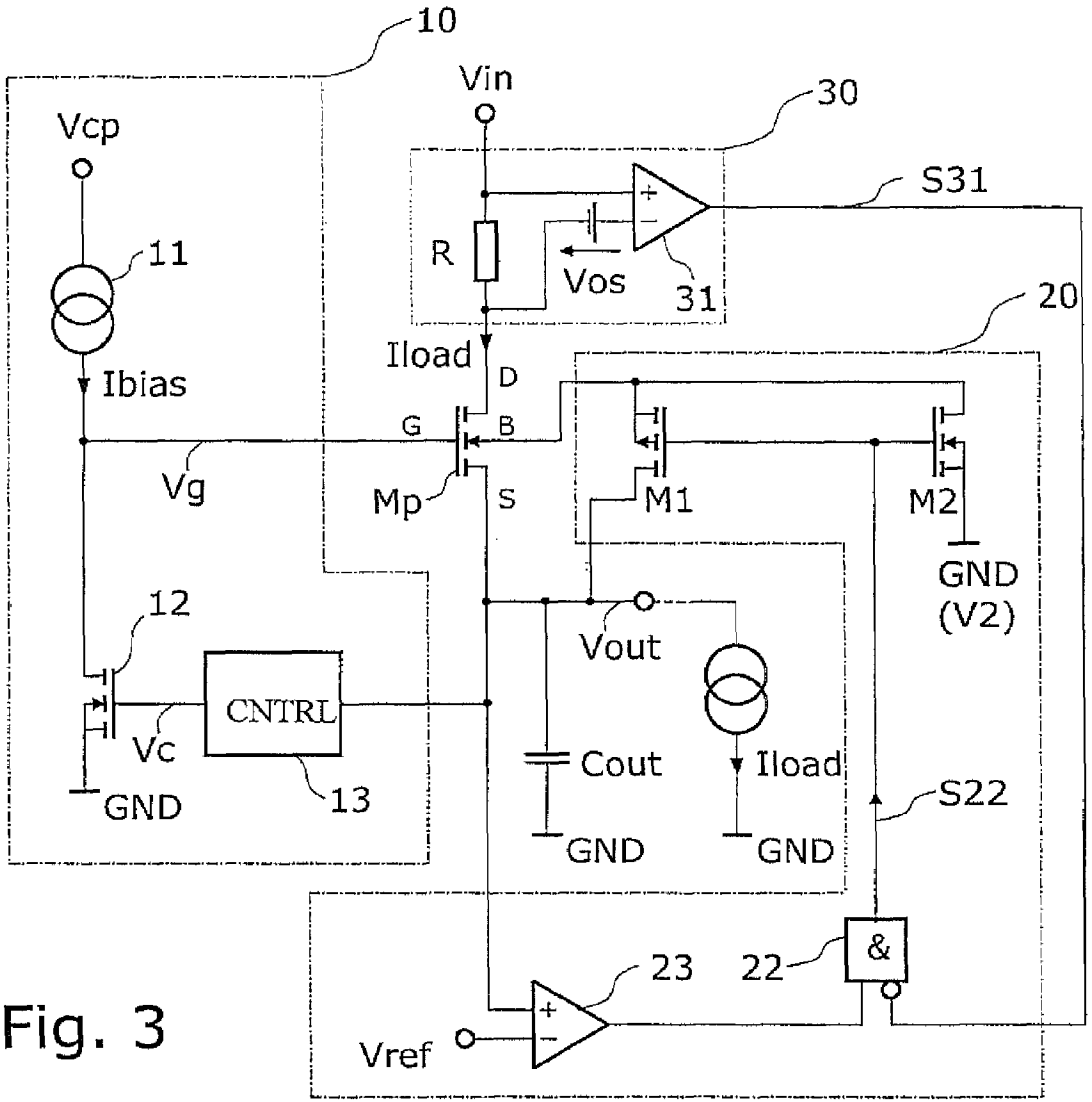
FIG. 3 shows the embodiment of FIG. 2 with the switching circuit being illustrated in more detail.

FIG. 3 shows the embodiment of FIG. 2 wherein the measurement means 30 and the switching circuit 20 are illustrated in more detail. The measurement circuit 30 comprises a shunt resistor R, a voltage source providing the offset voltage Vos and a comparator 31. The shunt resistor is connected to the drain terminal D of the power MO8FET Mp with its first terminal in series to the drain-source path of the power MOSFET. A second terminal of the shunt resistor R is connected to a non-inverting input of the comparator 31 and the first terminal of the shunt resistor R is also connected to the inverting input of the comparator 31 via the voltage source providing the offset voltage Vos. The output signal of the comparator assumes a first logic level, e.g. a high level, if the load current Iload is higher than a reference current defined by the quotient Iref=Vos/R of the shunt resistor R and the offset voltage Vos. Of course any other method for measuring the load current Iload and comparing it with a reference current is applicable (e.g. a sense-FET).

Additionally to the embodiment shown in FIG. 2 the switching 20 circuit comprises a comparator 23, an AND-gate 22 with an inverting and a non-inverting input, and transistors M1, M2 provide the functionality of the switch SW. The comparator 23 is adapted for comparing the output voltage Vout with a reference voltage Vref and for providing an output signal which assumes a first logic level, e.g. a high level, if the output voltage is higher than the reference voltage. The output of the comparator 23 is connected with the non-inverting input of the AND-gate 22. The inverting input of the AND-gate 22 is connected with the output of the comparator 31 which has been described above. The AND-gate 22 provides a switching signal S22 controlling the switching states of the transistors M1, M2.

In the current embodiment the switching signal S22 assumes a first logic level, e.g. a high level, if the load current Iload is lower than a reference current defined by the quotient Vos/R and the output voltage is higher than the reference voltage Vref. Then the first p-MOS transistor M1 is switched to an off-state and the n-MOS transistor M2 is switched to an on-state, thus isolating the bulk terminal B of the power MOSFET Mp from the output terminal providing the output voltage Vout (and also from its source terminal S) and connecting the bulk terminal B of the power MOSFET Mp with the constant potential V2 which is—in the current case—equal to the ground potential.

If either the output voltage drops below the reference voltage Vref or the load current rises above the reference current defined by the quotient Vos/R the output logic level of one of the comparators 23, 31 will change and the output signal S22 of the AND-gate 22 will switch to a second logic level, e.g. a low level, thus switching on the p-MOS transistor M1 and switching off the n-MOS transistor M2 and the p-MOS transistor M3. The bulk terminal B of the power MOSFET Mp is than connected to the source terminal S of the power MOSFET Mp and isolated from the constant potential V2.

Figure 5:
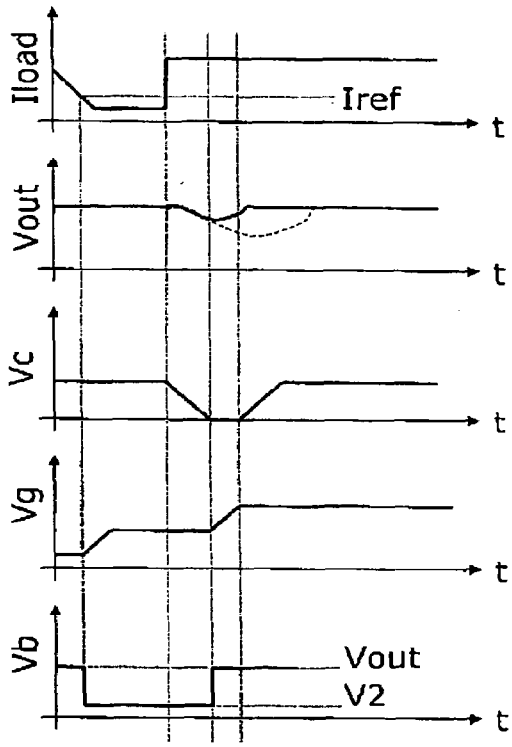
FIG. 5 shows timing diagrams of the load current, the output voltage, the gate voltage and the bulk voltage illustrating the step response of an voltage regulator according to FIG. 2 or 3.

Connecting the bulk terminal either with a constant potential V2 or with the source terminal S will change the threshold voltage of the voltage regulating power MOSFET Mp. The effect of this change of the threshold voltage on the speed of the feedback circuit can easily be explained by the help of FIG. 5. FIG. 5 shows, like FIG. 4, timing diagrams of the load current Iload, the output voltage Vout, the control voltage Vc, the gate voltage Vg, and the bulk voltage Vb. The left hand side of the timing diagram of Iload shows the load current Iload dropping below the reference current Iref=Vout/R. As a consequence the bulk terminal B is isolated from the source terminal S and connected with a constant potential V2. This results in an increase of the threshold voltage of the power MOSFET Mp and the controller 13 (via the controlling transistor 12) has to adjust the gate voltage Vg to a higher value, i.e the gate G of the power MOSFET Mp is pre-charged during the second switching state when the load current Iload is below the reference current and the output voltage Vout is above the reference voltage Vref. In response to an upward step in the load current Iref a drop in the output voltage Vout will be observed. Due to the rise of the load current Iload the bulk terminal B of the power MOSFET Mp will again be connected with the source terminal S and therefore the threshold voltage of the power MOSFET Mp is decreased again. Due to the fact, that the gate G of the power MOSFET Mp was precharged before, less charge is necessary to increase the gate voltage to a value necessary for compensating for the increase load current. As a consequence the feedback circuit 10 can react much faster for regulating the output voltage Vout to its desired constant value and the charging time tC is greatly reduced, thus improving the overall performance of the voltage regulator.

The invention claimed is:

1. A voltage regulator comprising:

a power field effect transistor having a threshold voltage, a drain terminal receiving an input voltage, a source terminal providing an output voltage and a load current, a gate terminal responsive to a control signal, and a bulk terminal;

a control-loop circuit responsive to the output voltage and providing the control signal, the control-loop circuit being configured to adjust the control signal to such a value that the output voltage is regulated to a constant value, wherein the threshold voltage of the power field effect transistor is modified dependent on the load current;

a switching circuit configured to connect the bulk terminal with the source terminal or with a constant potential dependent on the load current and/or the output voltage, wherein the switching circuit is configured to, connect the bulk terminal with the source terminal if the load current is higher than a reference current, and connect the bulk terminal with the constant potential if the load current is lower than the reference current;

or connect the bulk terminal with the source terminal if the output voltage is lower than a reference voltage, and connect the bulk terminal with the constant potential if the output voltage is higher than the reference voltage.

2. The voltage regulator of claim 1, wherein the switching circuit is configured to connect the bulk terminal with the source terminal if the output voltage is lower than a reference voltage, and connect the bulk terminal with the constant potential if the output voltage is higher than the reference voltage.

3. The voltage regulator of claim 1, wherein the switching circuit is configured to connect the bulk terminal with the source terminal if the load current is higher than a reference current or the output voltage is lower than a reference voltage, and connect the bulk terminal with the constant potential, if the load current is lower than the reference current and the output voltage is higher than the reference voltage.

4. The voltage regulator of claim 1, wherein the constant potential is lower than the output voltage.

5. The voltage regulator of claim 1, wherein the constant potential is equal to a ground potential.

6. A voltage regulator comprising:

a power field effect transistor having a threshold voltage; a drain terminal receiving an input voltage, a source terminal providing an output voltage and a load current, a gate terminal responsive to a control signal, and a bulk terminal;

a control-loop circuit responsive to the output voltage and providing the control signal, the control-loop circuit being configured to adjust the control signal to such a value that the output voltage is regulated to a constant value, wherein the threshold voltage of the power field effect transistor is modified dependent on the load current;

a switching circuit configured to connect the bulk terminal with the source terminal or with a constant potential dependent on the load current and/or the output voltage, wherein the switching circuit is configured to connect the bulk terminal with the source terminal if the load current is higher than a reference current, and connect the bulk terminal with the constant potential if the load current is lower than the reference current.

7. The voltage regulator of claim 6, wherein the constant potential is equal to a ground potential.

8. The voltage regulator of claim 6, wherein the constant potential is lower than the output voltage.

9. A method for controlling a power field effect transistor having a threshold voltage, a drain terminal receiving an input voltage, a source terminal providing an output voltage and a load current, a gate terminal responsive to a control signal, and a bulk terminal; the method comprising modifying the threshold voltage dependent on the load current and/or the output voltage by connecting the bulk terminal with the source terminal or with a constant potential dependent on the load current, wherein said modifying further comprises comparing the load current with a reference current, connecting the bulk terminal with the source terminal if the load current is higher than the reference current, and connecting the bulk terminal with a constant potential if the load current is lower than the reference current.

* * * * *